US006334389B1

(12) United States Patent
Fischer

(10) Patent No.: US 6,334,389 B1
(45) Date of Patent: Jan. 1, 2002

(54) DRIVE MECHANISM FOR THE CYLINDERS OF A PRINTING PRESS

(75) Inventor: Christian Martin Michael Fischer, Marktheidenfeld (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 09/581,151

(22) PCT Filed: Dec. 10, 1998

(86) PCT No.: PCT/DE98/03625

§ 371 Date: Jun. 12, 2000

§ 102(e) Date: Jun. 12, 2000

(87) PCT Pub. No.: WO99/30906

PCT Pub. Date: Jun. 24, 1999

(30) Foreign Application Priority Data

Dec. 12, 1997 (DE) ..... 197 55 316

(51) Int. Cl.[7] ..... B41F 5/00

(52) U.S. Cl. ..... 101/216; 101/219

(58) Field of Search ..... 101/212, 216, 101/217, 218, 219, 247, 248, 211, 181, 182, 183

(56) References Cited

U.S. PATENT DOCUMENTS

| | | | | | |
|---|---|---|---|---|---|
| 2,003,799 | A | * | 6/1935 | Barber | 101/218 |
| 3,730,090 | A | | 5/1973 | Lamberg et al. | |
| 5,485,782 | A | * | 1/1996 | Van Der Horst | 101/216 |
| 5,570,633 | A | * | 11/1996 | Schultz et al. | 101/182 |
| 5,771,804 | A | * | 6/1998 | Knauer et al. | 101/216 |
| 5,782,182 | A | | 7/1998 | Ruckmann et al. | |
| 5,943,955 | A | * | 8/1999 | Niemiro et al. | 101/216 |

FOREIGN PATENT DOCUMENTS

| | | |
|---|---|---|
| DE | 44 08 025 A1 | 9/1995 |
| DE | 44 30 693 A1 | 3/1996 |
| EP | 644 048 A2 | 3/1995 |
| GB | 771198 | 3/1957 |
| JP | 56021860 | 7/1979 |

* cited by examiner

*Primary Examiner*—Eugene Eickholt
(74) *Attorney, Agent, or Firm*—Jones Tullar & Cooper, P.C

(57) ABSTRACT

A drive mechanism for cylinders in a rotary press utilizes a plurality of motors associated with various cylinders. These motors are offset axially with respect to each other.

9 Claims, 3 Drawing Sheets

DRIVE MECHANISM FOR THE CYLINDERS OF A PRINTING PRESS

FIELD OF THE INVENTION

Figure 1:
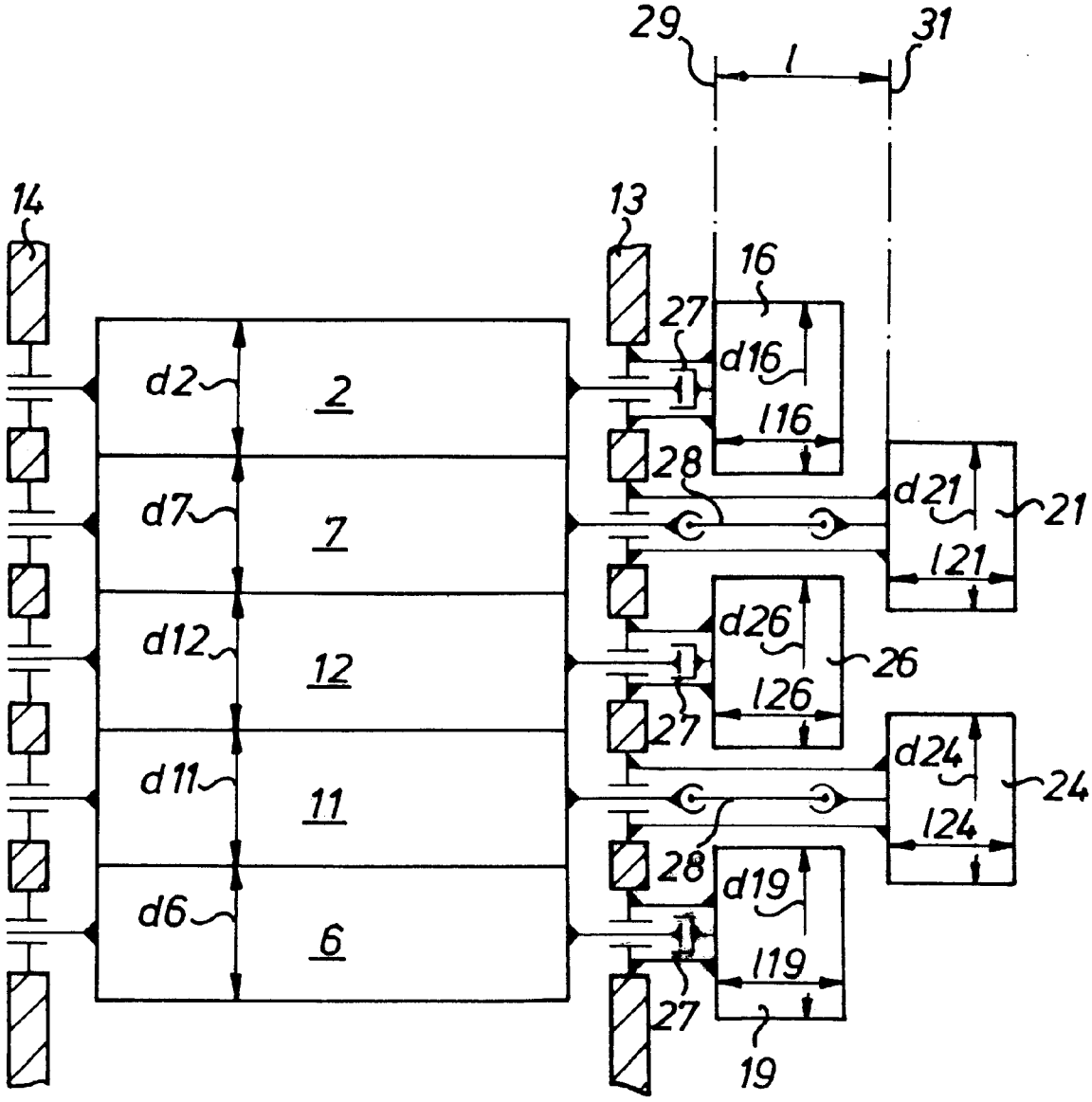

The present invention is directed to a drive mechanism for the cylinders of a printing press.

A plurality of drive motors are assigned to the cylinders and are arranged axially offset.

DESCRIPTION OF THE PRIOR ART

A rotary offset printing press with rubber blanket and plate cylinders is known from EP 0 644 048 A2. For being driven together, these rubber blanket and plate cylinders have been combined in pairs into cylinder groups by a mechanical coupling. Each of these cylinder groups is driven by its own drive motor.

DE 44 30 693 A1 discloses printing units of a rotary offset printing press, wherein at least one cylinder is individually driven. Associated plate and rubber blanket cylinders are combined into groups for being driven.

U.S. Pat. No. 3,730,090 A describes an ink duct with individually adjustable inking blades. These inking blades are adjusted by means of step motors, which are arranged in an offset manner.

JP-A 56-21860 discloses individually driven cylinders of a printing unit.

SUMMARY OF THE INVENTION

The present invention is has the object of providing a drive mechanism for cylinders of a printing press.

In accordance with the present invention, this object is attained by the provision of a plurality of drive motors for the cylinders of the printing press. At least two of the drive motors assigned to the cylinders are arranged offset in respect to each other in the axial direction of the cylinders.

With the drive mechanism for cylinders of a printing press in accordance with the present invention, it is possible, in an advantageous manner, to use drive motors whose diameter is greater than the diameter of the cylinder for adjoining cylinders having their own drive motor.

Such an arrangement of the drive motors also allows satisfactory access for maintenance and repair work of the drive motors. This access is also facilitated in case of drive motors whose diameter is less than the diameter of the associated cylinder.

If movable cylinders, for example rubber blanket cylinders seated in eccentric bushings, are connected by means of a coupling, for example a universal joint shaft, with a drive motor, a small angular offset of the coupling is achieved by an arrangement which is distanced from a lateral frame.

Figure 2:
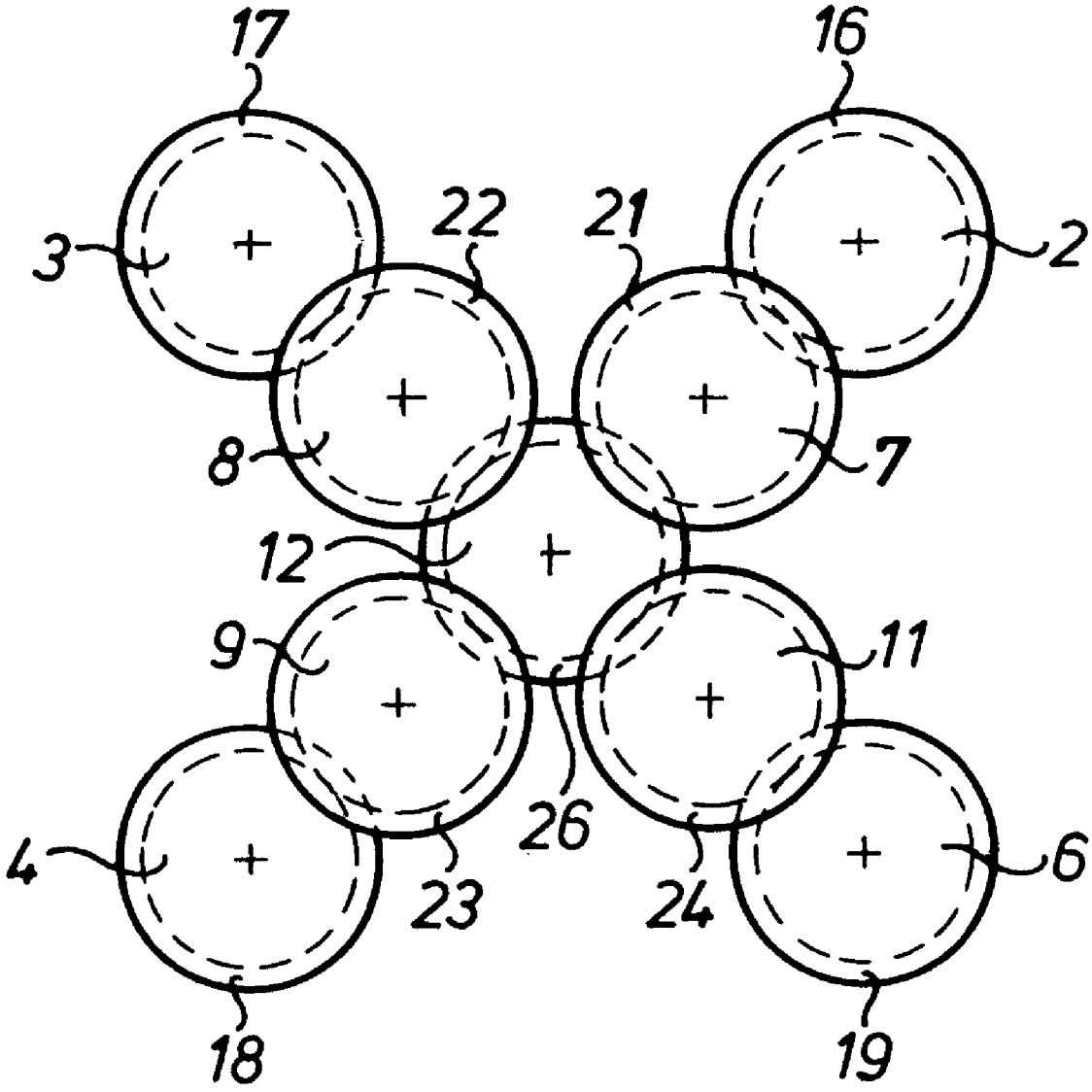
Figure 3:
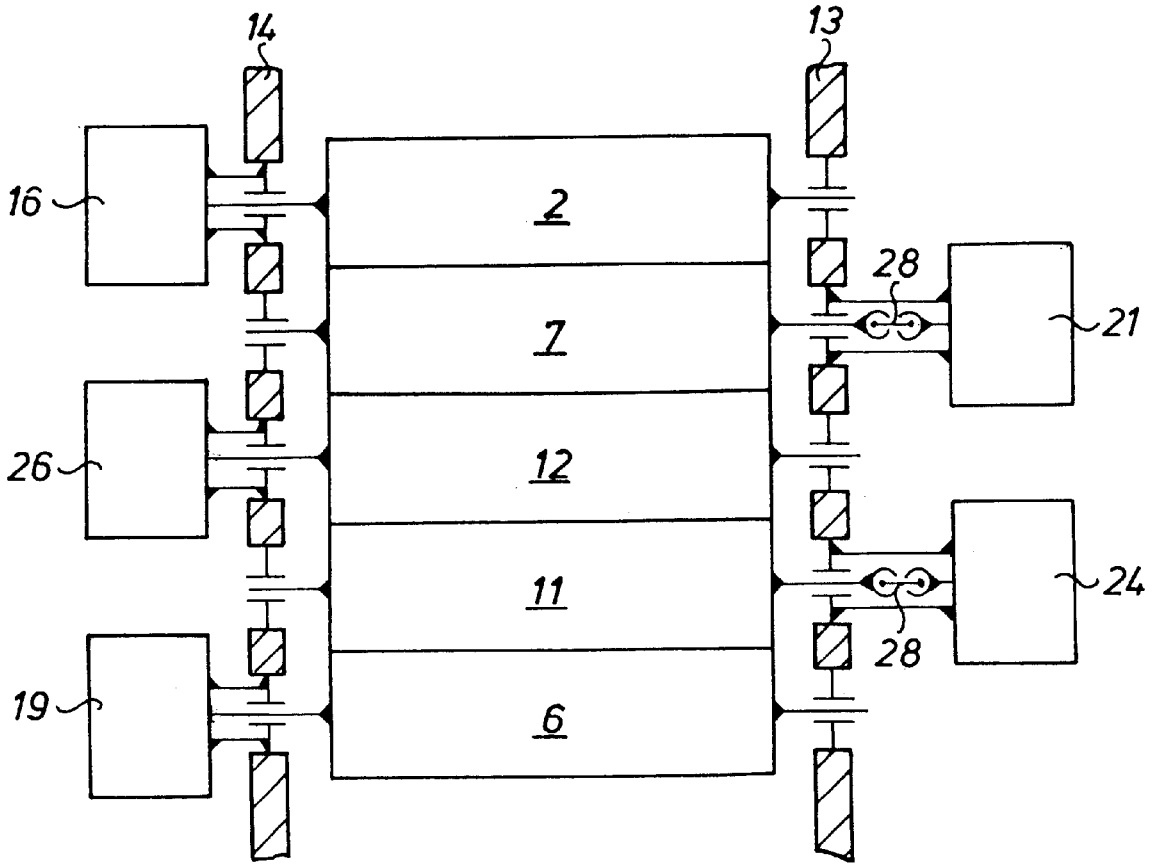

BRIEF DESCRIPTION OF THE DRAWINGS preferred embodiments of the present invention are represented in the drawings and will be described in greater detail in what follows. Shown are in:

FIG. 1, the schematic representation of a view from above on a printing unit of a first preferred embodiment, FIG. 2, the schematic representation of a lateral view from the right side of a printing unit without a lateral frame of the first preferred embodiment, and in FIG. 3, the schematic representation of a view from above on a printing unit of a second preferred embodiment.

DESCRIPTION OF PREFERRED EMBODIMETS

In the present, first preferred embodiment as depicted in FIGS. 1 and 2 a printing unit 1 of an offset rotary printing press is embodied in the form of a so-called nine piece satellite printing unit. This printing unit 1 is essentially formed by four printing cylinders 2, 3, 4 and 6 and by four transfer cylinders, 7, 8, 9, 11, for example printing cylinders 2, 3, 4 and 6 and rubber blanket cylinders, 7, 8, 9, 11, and by a counter-pressure cylinder 12. The rubber blanket cylinders 7, 8, 9, 11 can be selectively placed against the counter-pressure cylinder 12 for printing a web. It is also possible to place adjoining rubber blanket cylinders 7, 8, 9, 11 selectively against each other, which adjoining blanket cylinders then print the front and back of a web.

These printing and rubber blanket cylinders 2, 3, 4, 6; 7, 8, 9, 11 are provided with journals, which are seated in lateral frames 13, 14 of the offset rotary printing press. In a known manner, the printing and/or rubber blanket cylinders 2, 3, 4, 6, 7, 8, 9, 11 are arranged to be moved into or out of contact with each other and with cylinder 12, for example by means of eccentric bushings. For example, the rubber blanket cylinders 7, 8, 9, 11 can be arranged to be moved into or out of contact with the associated printing cylinders 2, 3, 4, 6 and/or with the counter-pressure cylinder 12. The printing cylinders 2, 3, 4, 6 can also be moved into or out of contact with the rubber blanket cylinders 7, 8, 9, 11.

The journals of the printing and rubber blanket cylinders 2, 3, 4, 6, 7, 8, 9, 11 extend through the lateral frame 13 at a drive side of the printing unit 1. In the first preferred present exemplary embodiment, each cylinder 2, 3, 4, 6, 7, 8, 9, 11, 12 has its own drive mechanism which may be, for example a position-controlled electric motor 16, 17, 18, 19, 21, 22, 23, 24, 26, as seen in FIG. 1 and 2. The rotors of these drive motors 16, 17, 18, 19, 21, 22, 23, 24, 26 are connected, for example directly, i.e. without a gear, such as, or by means of a gear, for example an integrated planetary gear, with the journals of the respective cylinders 2, 3, 4, 6; 7, 8, 9, 11, 12. Also, a compensating coupling 27 is arranged in an advantageous manner between each of the drive motors 16, 17, 18, 19, 21, 22, 23, 24, 26 and the associated journals of the cylinders 2, 3, 4, 6, 7, 8, 9, 11, 12. In the first preferred embodiment, a double-joint coupling 28, for example a universal joint, is arranged, fixed against relative rotation, between the journals of the movable rubber blanket cylinders 7, 8, 9, 11 and the respective associated drive motor 21, 22, 23, 24 for each rubber blanket cylinder. In the present preferred embodiment, the drive motors 16, 17, 18, 19, 21, 22, 23, 24, 26 are arranged fixed in place on the frame. The drive motors 16, 17, 18, 19, 21, 22, 23, 24, 26 are represented schematically in FIG. 1 and FIG. 2 in a cylinder shape. This does not necessarily mean that they have to be embodied exactly in a cylinder shape, instead, it is intended for other geometric shapes (for example cube-shaped), or projecting parts, to be included by the schematically depicted cylinder shape In the present exemplary embodiment, all drive motors 16, 17, 18, 19, 21, 22, 23, 24, 26 are identical and have a greater diameter d16, d19, d21, d24, d26 than the diameters d2, d6, d7, d11, d12 of the associated cylinders. However, it is also possible to employ different drive motors within a printing unit.

The drive motors 16, 17, 18, 19, or respectively 26, of the printing cylinders 2, 3, 4, 6 and of the counter-pressure cylinder 12 are arranged in a first plane 29, as seen in FIG. 1. The drive motors 21, 22, 23, 24 of the rubber blanket cylinders 7, 8, 9, 11 are arranged in a second plane 31 also as seen in FIG. 1. The first plane 29 and the second plane 31 are spaced apart, are we parallel with each other and extend vertically in respect to the axes of rotation of the cylinders.

The drive motors 16, 17, 18, 19, or respectively 26, of the printing cylinders 2, 3, 4, 6 and of the counter-pressure cylinder 12 are spaced apart from each other in the axial direction of the cylinder, i.e. they are arranged offset with respect to the other drive motors.

In place of the motor groupings groups provided for the printing, or respectively counter-pressure cylinders, and for the rubber blanket cylinders, it is also possible to provide motor groupings. However, it is common to all such arrangements or motor groupings that at least the drive motors of cylinders, which work directly together, are arranged offset with respect to each other in the axial direction.

The length l of the axial offset as seen in FIG. 1 advantageously corresponds to at least a length 116, 119, 121, 124, 126 of a housing of a drive motor 16, 19, 21, 24, 26.

In a second preferred embodiment, as seen in FIG. 3 the drive motors 21, 22, 23, 24, of the rubber blanket cylinders 7, 8, 9, 11 are arranged on the first lateral frame 13 which is the so-called drive side SII, and the drive motors 16, 17, 18, 19, 26, of the printing cylinders 2, 3, 4, 6 and of the counter-pressure cylinder 12 are arranged on the second lateral frame 14 which is the so-called operating side SI. The drive motors 21, 22, 23, 24 assigned to the journals of the rubber blanket cylinders 7, 8, 9, 11 are arranged opposite the drive motors 16, 17, 18, 19, 26 assigned to the opposite journals of the printing cylinders 2, 3, 4, 6 and of the counter-pressure cylinder 12. The drive motors 21, 22, 23, 24, of the rubber blanket cylinders 7, 8, 9, 11 are assigned to the first lateral frame 13, and the drive motors 16, 17, 18, 19, 26, of the printing cylinders 2, 3, 4, 6 and of the counter-pressure cylinder 12 are assigned to the second lateral frame 14, i.e. fastened directly or indirectly on the lateral frame 13, or respectively 14.

The drive motors, arranged in an offset manner, can also be used in a ten piece satellite printing unit in particular, instead of in a nine piece satellite printing unit, wherein preferably each cylinder has its own drive motor assigned.

In these described preferred embodiments, each cylinder of a printing unit is assigned its own drive motor. It is also possible to drive cylinder groups, for example consisting of printing and transfer cylinders, respectively by means of a drive motor within a printing unit. In this case, the drive motors are also offset with respect to each other in the axial direction. For example, the drive motors of the cylinder groups in respect to a drive motor of a counter-pressure cylinder can be offset.

This arrangement of drive motors can also be employed in a folding apparatus or in other units, such as a roll changer a superstructure of a printing press.

While preferred embodiments of a drive mechanism for the cylinder of a printing press have been set forth fully and completely hereinabove, it will be apparent to one of skill in the art that a number of changes in, for example, the overall sizes of the various cylinders, the specific types of cylinders and the like could be made without departing from the true spirit and scope of the present invention which is accordingly limited only by the following claims:

What is claimed is:

1. A drive mechanism for a printing press comprising:

a plurality of cylinders in the printing press, each of said cylinders having an axis of rotation; and a plurality of drive motors associated with said plurality of cylinders, at least two of said drive motors being offset with respect to each other in an axial direction with respect to said plurality of cylinder, each of said plurality of drive motors having a drive motor length and further wherein an offset length between said at least two offset drive motors is greater than said drive motor length.

2. The drive mechanism of claim 1 wherein said at least two offset drive motors are associated with two cylinders of said plurality of cylinders which work directly together.

3. The drive mechanism of claim 1 wherein the printing press includes at least a first side and further wherein all of said drive motors are arranged on said first side of the printing press.

4. The drive mechanism of claim 1 wherein said plurality of cylinders are arranged in a folding apparatus.

5. A drive mechanism for a printing press comprising:

a plurality of cylinders arranged in a printing unit in the printing press, each of said cylinders having an axis of rotation; and a plurality of drive motors associated with said plurality of cylinders, at least two of said drive motors being offset with respect to each other in an axial direction with respect to such plurality of cylinders, each one of said plurality of cylinders having its own one of said plurality of drive motors associated with it.

6. The drive mechanism of claim 5 wherein said printing unit is a nine piece satellite printing unit of an offset rotary printing press.

7. The drive mechanism of claim 5 wherein said printing unit is a ten piece satellite printing unit of an offset rotary printing press.

8. A drive mechanism for a printing press comprising:

a plurality of cylinders in the printing press, each of said cylinders having an axis of rotation; and a plurality of drive motors associated with said plurality of cylinders, at least two of said drive motors being offset with respect to each other in an axial direction with respect to said plurality of cylinders, said printing press having a first side and a second side and wherein each of said cylinders has an associated cylinder journal, drive motors for a first group of said cylinders being secured to said journals associated with said first group of said cylinders on said first side of said printing press, drive motors for a second group of said cylinders being secured to said journals associated with said second group of said cylinders on said second side of said printing press.

9. A drive mechanism for a printing press comprising:

a plurality of cylinders in the printing press, each of said cylinders having an axis of rotation; and a plurality of drive motors associated with said plurality of cylinders, at least two of said drive motors being offset with respect to each other in an axial direction with respect to said plurality of cylinders, one of said plurality of drive motors associated with said plurality of cylinders being assigned to one of said cylinders whose position can change.

* * * * *